US005559589A

United States Patent [19]

Eichberger et al.

[11] Patent Number: 5,559,589

[45] Date of Patent: Sep. 24, 1996

[54] KEYING METHOD AND APPARATUS

[75] Inventors: David Eichberger, Houston; Nicholas G. Forlenza, Cypress, both of Tex.

[73] Assignee: Compaq Computer Corporation, Houston, Tex.

[21] Appl. No.: 468,981

[22] Filed: Jun. 6, 1995

Related U.S. Application Data

[63] Continuation of Ser. No. 127,247, Sep. 27, 1993, abandoned.

[51] Int. Cl.[6] ..... G03G 15/06

[52] U.S. Cl. ..... 355/260; 355/200; 355/210; 347/138; 347/152

[58] Field of Search ..... 355/260, 245, 355/326 R, 327, 200, 210; 222/DIG. 1; 206/515, 514, 576, 580, 464; 70/63, 57; 347/138, 152

[56] References Cited

U.S. PATENT DOCUMENTS

| | | | |
|---|---|---|---|
| 4,010,839 | 3/1977 | Guerrini et al. . | |
| 4,534,667 | 8/1985 | Bury . | |
| 4,773,776 | 9/1988 | Gomoll et al. . | |
| 4,943,828 | 7/1990 | Manabe et al. | 355/200 |
| 4,949,123 | 8/1990 | Takashima | 355/260 |
| 4,963,939 | 10/1990 | Kurando et al. | 355/260 |
| 5,023,660 | 6/1991 | Ebata et al. | 355/200 |
| 5,064,301 | 11/1991 | Nakamura et al. . | |
| 5,078,303 | 1/1992 | Kikuchi et al. | 355/260 X |
| 5,083,158 | 1/1992 | Kashima et al. | 355/200 |
| 5,184,181 | 2/1993 | Kurando et al. | 355/260 |
| 5,229,824 | 7/1993 | Tsusuka et al. | 355/260 |
| 5,245,394 | 9/1993 | Ikeda et al. | 355/210 X |
| 5,268,722 | 12/1993 | Ikkatai et al. | 355/260 |

*Primary Examiner*—Matthew S. Smith
*Attorney, Agent, or Firm*—Fish & Richardson P.C.

[57] ABSTRACT

The field of the invention is an improved keying system for categorizing a consumable cartridge by using a two component system including a relatively long-lived portion and the relatively short-lived consumable cartridge. The improved system includes a lug element and a structure for mounting the lug element to the relatively long-lived portion, which may be the inner housing of a copier machine or other machine using consumable cartridges. Ideally, the lug element is self-fixturing into a void space. The consumable cartridge has portions defining a void into which the lug element projects when the consumable cartridge is inserted into the relatively long-lived portion for machine operations.

17 Claims, 3 Drawing Sheets

KEYING METHOD AND APPARATUS

This is a continuation of application Ser. No. 08/127,247, filed Sep. 27, 1993, now abandoned.

BACKGROUND OF THE INVENTION

This invention relates to systems for categorizing or keying attachments such as a toner cartridge to a base systems such as a printer.

Separation of systems into relatively permanent pieces of equipment and less permanent modules is customary and exemplified by, for example, toner cartridges in printers, ribbon cartridges in typewriters, cassettes in audio players and the like. Such modules facilitate use of the system by providing easy and convenient replacement of consumable components, such as cassettes. Office equipment often consists of hardware and a module or cartridge that is inserted into or otherwise attached to the hardware. The modules usually contain a consumable, such as an ink ribbon. Such a module or cartridge containing an ink ribbon is quite often inserted into a cartridge receiving compartment built into a printer or typewriter. The module when used can be quickly and easily removed, disposed of, and replaced after it is completely consumed. It is often desirable to be able to control by some means of categorization the use of modules in a particular piece of equipment. Categorization is especially useful, and often necessary, if more than one type of consumable component can be present in similar or identical base systems.

Toner cartridges for printers come in a variety of types and quality, some of which do not work well or at peak performance when they are used in certain machines. Cartridges produced by one manufacturer may not operate as well in a printer made by another manufacturer. Internal toner cartridge components for printers and copiers are different, but the outer shell of the cartridge may be similar. Thus, for various reasons, it is desirable to be able to mechanically categorize consumable components in various categories, such as size, shape, orientation and quality.

Thus, there is a need for improved systems for "keying" consumable components into predetermined categories to prevent the consumable component from being improperly used, which may result in damage to a machine in which it is used.

SUMMARY OF THE INVENTION

This invention is a simple, inexpensive, easily implemented, and relatively foolproof system for categorizing cartridges and other attachments.

The invention comprises two components which are keyed to each other to facilitate categorization of one of the components. The invention includes a first component which is long-lived, and a second consumable component. A lug element provides a keying interconnection between the two components. It includes a means for connecting the lug element to one components, in which one component has a portion or portions defining a void into which the lug element projects.

The lug element may comprise a self-fixturing means, may be made as a separate component and attached by adhesive or mechanical means such as screws, or detachable snap-in means. It is preferred that the lugs not be readily observable. Further, the lugs extend into a void space in the consumable component housing. The invention also comprises a consumable component housing that has at least one slot and a lug element in the permanent component adapted to fit into the slot or slots in the consumable housing when the consumable is attached or inserted into the permanent component.

Advantages of the invention include that it provides an apparatus and a system that is easily manufactured, is difficult to defeat in the ordinary course of use, may be made by a manufacturer or added as a component of an existing system, and can be modified by a technician who has access to the inside of the permanent portion of the apparatus. The invention also does not appear to be modifiable to the consumer, which is an advantage.

Other advantages and features will be apparent from the following description and the claims.

DESCRIPTION OF THE PREFERRED EMBODIMENTS

This invention includes a lug element which may be applied in numerous different types of machines. For example, different types of office machines such as printers, copiers, video tape machines, cameras, and other appliances may use a lug of the type shown in this invention. The preferred embodiment, however, is to use the lug in a printer, and in conjunction with a toner cartridge.

Furthermore, there are several alternative embodiments for the lug element which are shown in FIGS. 7–10. Generally, there are at least four different ways that the lug element may be used in this invention, to effect the desired categorization of a consumable cartridge while providing the most desirable adaptation of the consumable cartridge in that particular embodiment. For example, the preferred embodiment where a toner cartridge is used in a printer is to have the lug element adhesively attached to the housing on the inside of the printer. Of course, it may be readily observed that there are numerous other methods of attachment of a lug element to a housing, and this invention is not limited to any particular method of attachment. Other methods which are seen in this invention, and specifically shown, include attachment by the use of tines, attachment by screws, and attachment by using a molded structure that is a permanent and continuous part of the housing itself.

Figure 1:
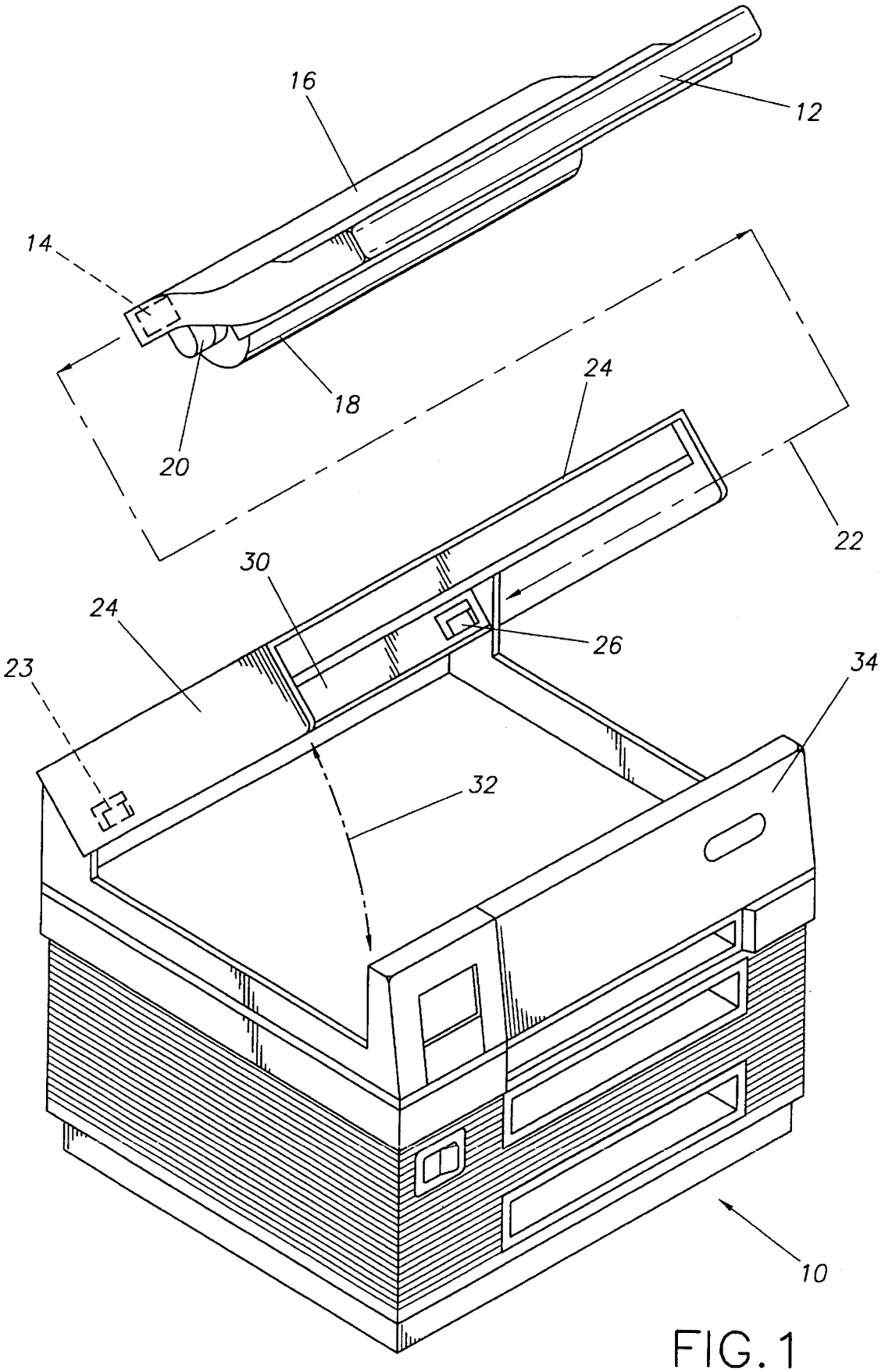
FIG. 1 is a perspective view of a portion of a printer which shows a consumable toner cartridge in a hinged housing of a printer.

Referring now to the figures, FIG. 1 depicts the preferred embodiment of this invention manifested in a printer 10 which is a relatively long-lived portion. In order to print, the printer requires a toner cartridge 12 as seen in FIG. 1. The cartridge is removable, and is a consumable item that works in conjunction with the printer to provide toner in printing transparencies, paper, or perhaps other materials. The toner cartridge 12, as seen in the arrows in FIG. 1, is inserted into the top receptacle housing 24 of the printer 10. The top receptacle housing is hingedly mounted upon the printer, and it is hinged to be raised along the line of rotation 32 defined by the hinge axis to receive the toner cartridge 12. A toner cartridge is used up, and the toner is depleted until the cartridge is no longer operable in the machine, and the cartridge must be discarded. When the machine is operating, the top receptacle housing 24 is in its closed position, wherein it is pushed down onto the body of the lower printing unit 34, whereby the toner cartridge 12 may be applied in the printing action.

The toner cartridge 12 is comprised of an upper housing 16 which contains at either end void spaces 14 which are rectangular in shape, and they represent a "cut out" portion of the plastic housing which is adapted to receive a lug element. Connected to the upper housing 16 is the roller 18, and the roller axle 20. The entire toner cartridge unit 12 is inserted as shown in the insertion direction arrow 22.

In the lower portion of FIG. 1, a right lug element 26 and a left lug element 28 are seen in the figure. The left lug element 28 is shown in dotted format, because it is actually located upon the base plate 30, and beneath the top receptacle housing 24 in the figure. The right lug element 26 is also located upon the base plate 30 which is a flat portion of the housing which comes in close contact and engages with the toner cartridge 12 when the toner cartridge is inserted into the top receptacle housing 24.

Figure 2:
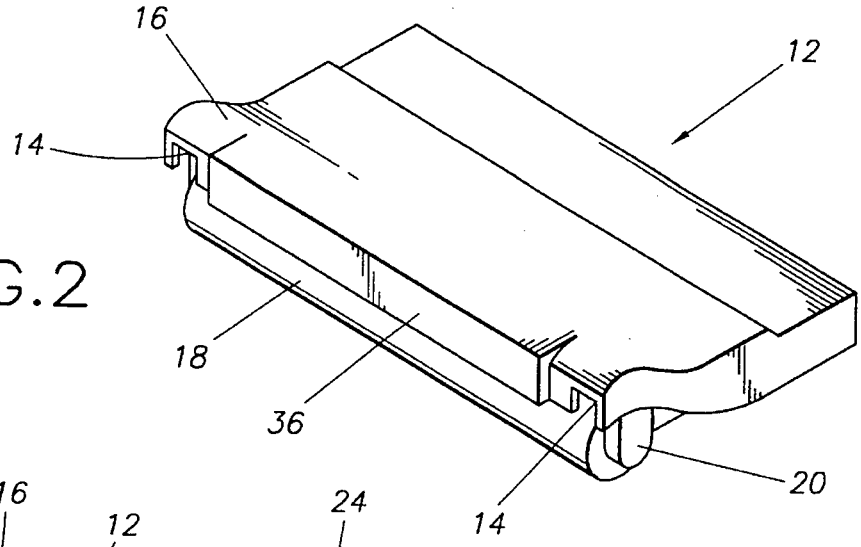
FIG. 2 is a perspective view of a toner cartridge showing voids in the upper housing of the toner cartridge into which a lug element projects when the cartridge is inserted into a printer.

In FIG. 2, a prospective view of the toner cartridge 12 is shown. The toner cartridge 12 may be seen with an upper housing 16, made of plastic (preferably), which contains void spaces 14 at either end. The roller 18 may be seen at the lower portion of the toner cartridge, and roller axle 20 is shown in FIG. 2. Camming surface 36 runs along the length of the toner cartridge 12, and provides the surface which helps align the cartridge with the base plate 30 of the printer to facilitate the use of the toner within the printer itself.

Figure 3:
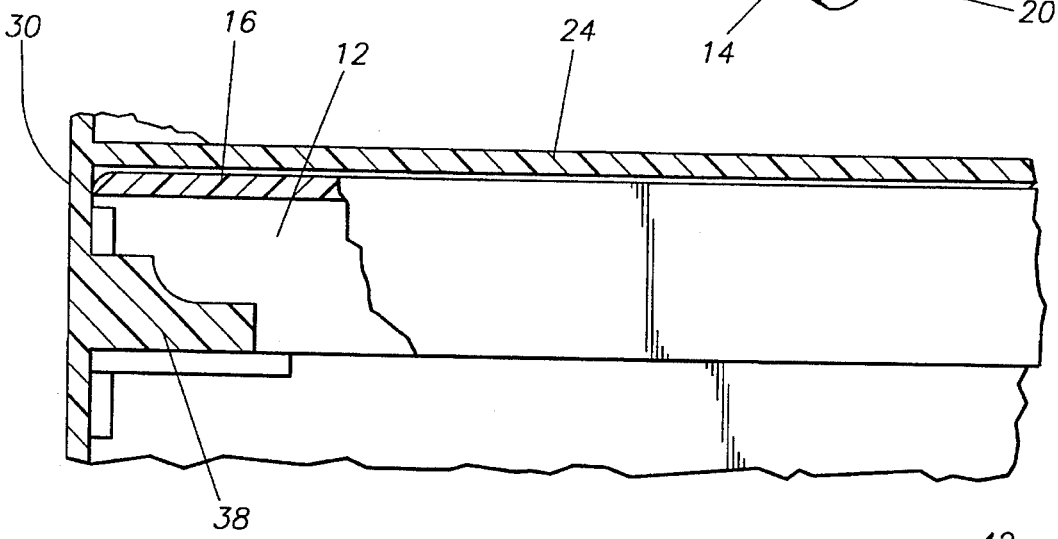
FIG. 3 is a cross-section view in which a lug element is projected from a position on the base plate of the printer into the void space of the cartridge housing.

FIG. 3 depicts a cross-sectional view of the preferred embodiment of the invention in which a lug element is projected from a position upon the base plate of the printer into the void space of the upper cartridge housing of the toner cartridge during operation of the printer. In this preferred embodiment, top receptacle housing 24 is seen, where it mates with base plate 30 in forming the receptacle which receives the toner cartridge 12. A lug element 38 is shown in the figure, projecting from the base plate of the printer into the void space of the toner cartridge 12.

Figure 4:
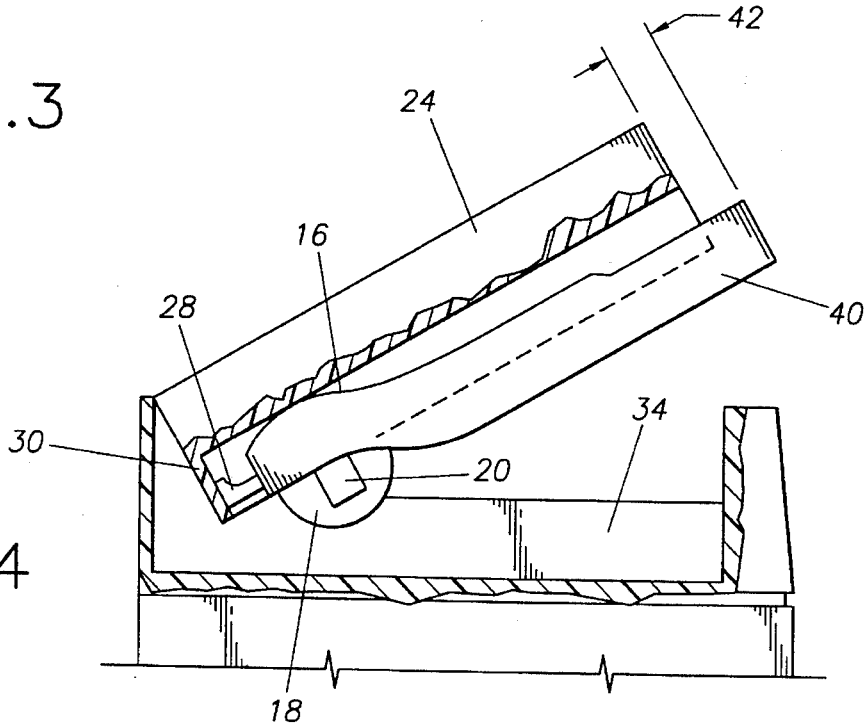
FIG. 4 is a cross-section of a printer in which an improper cartridge (without a void space) is inserted into the printer having a lug element, showing that closing the hinged top is prevented by the improper cartridge.

In FIG. 4, a cross-section is shown depicting one of the problems which is solved with this invention. In that figure, an improper cartridge without a void space in its housing has been inserted into a printer having a lug element, and it shows that the hinged top housing of the printer cannot be closed where an improper cartridge is inserted into the printer of this invention. In that figure, the left lug element 28 prevents the toner cartridge from being fully inserted into the top receptacle housing 24. The improper toner cartridge 40 may be seen extending out from the housing, and a maladjustment gap 42 can be seen where the cartridge, improperly inserted, prevents the top receptacle housing 24 from properly closing down upon the lower printing unit 34. Thus, the printer cannot be operated in this mode, and the use of a toner cartridge without a void space for adaptation to the lug element results in a printer that will not function. In this way, a manufacturer or a dealer may provide selectivity as to which toner cartridges will work in a machine, thereby providing a safer, more economical, and a better printing method which reduces the chance for operator error. The base plate 30 is seen in FIG. 4 as supporting the left lug element 28.

Figure 5:
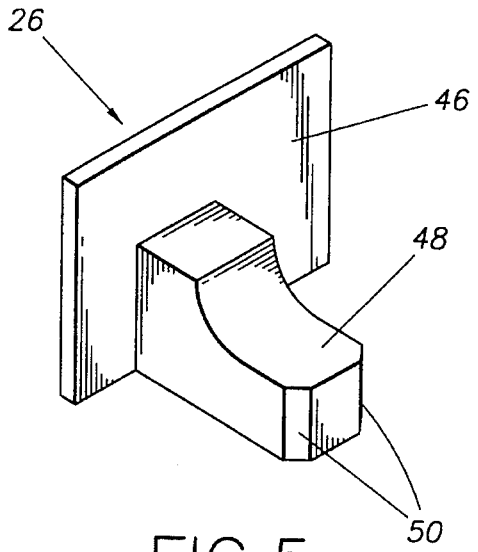
FIG. 5 is a perspective view of the preferred lug element.

In FIG. 5, a prospective view of the preferred embodiment of the lug element of this invention is shown. A projecting portion 48 extends out from the mounting portion 46. A pair of corner facets 50 may be designed so that the lug element may be free of sharp edges which could catch on the housing and prevent proper insertion of the lug element into the housing.

Figure 6:
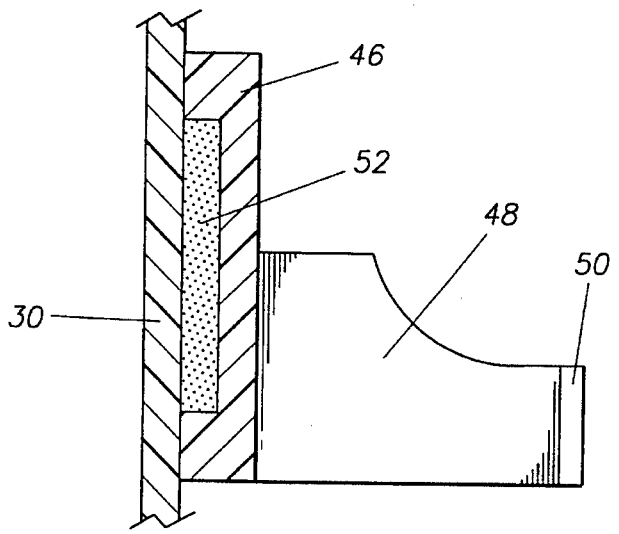
FIG. 6 is a cross-sectional view of the lug element in FIG. 5.

FIG. 6 shows the preferred embodiment of the invention which is shown in FIG. 5, only in cross-section. In that figure, the projection portion 48 is seen extending out from the mounting portion 46, and one of the corner facets 50 is seen. Importantly, a depression on the backside of the mounting portion 46 is shown as the adhesive well 52. In the preferred embodiment of the invention, the lug element is mounted lap on the base plate housing by adhesion using a standard adhesive of the type which is typically used in such machinery to glue plastic parts together. Adhesive well 52 forms a void space which may be filled with adhesive, to form a permanent bond between the mounting portion 46 and the base plate 30 seen in FIG. 6. Using this preferred arrangement, the lug element may be glued upon the base plate of machines that are already in service out in the field, and which have been in the industry for some time. Thus, this preferred arrangement allows machines which are already in service and in use by operators to be quickly adapted to use the categorization feature of this invention by merely gluing the lug element onto the base plate 30, and thereafter requiring that the toner cartridge be of the type that facilitates the use of a lug element by incorporating a void space in its housing. Further, in some instances, it may be desirable for a manufacturer to produce a printer which may be modified by a dealer to include the feature of this invention showing a lug element. A manufacturer may desire to manufacture a printer which may selectively be modified at the dealership to include a lug element, especially if the printer is sold in jurisdictions where inferior or improper toner cartridges are prevalent, or in cases where the use of an unauthorized toner cartridge would, for some other reason, be undesirable. In that case, the dealer could apply the lug element in a printer at the dealership, at his discretion, or upon the customers request.

Figure 7:
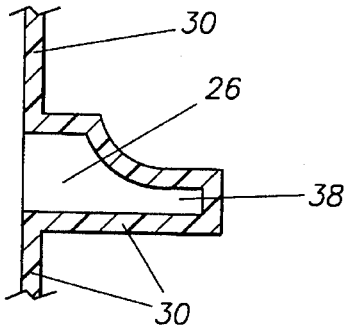
FIG. 7 is a cross-sectional view of an alternative lug element in its operating position in which the cartridge is correctly inserted.

In FIG. 7, an alternative embodiment of the invention is seen in which the base plate 30 of the housing of the printer is continuous with the lug element 38, and forms the outer surface of the lug element. Thus, the embodiment shown in FIG. 7 would arise in a case whereby the manufacturer desired to make a lug element which was permanent, and the lug element is integrally formed as part of the housing of the printer.

In some cases, the design of the lug element will be dictated by considerations relating to whether or not the lug element is seen by an operator or consumer as being removable. One of the factors to consider in determining which type of lug element is used is that consumers may try to override or overcome the keying aspect of this invention, especially if the consumer or operator is aware that the lug element is removable. The embodiment shown in FIG. 7 provides an embodiment in which the consumer could not simply "pry off" or otherwise remove the lug element, because the lug element in that case is integrally formed as part of the plastic housing itself, and it would be non-removable. If a consumer tried to remove the lug element shown in FIG. 7, it could not be done without breaking the housing.

Figure 8:
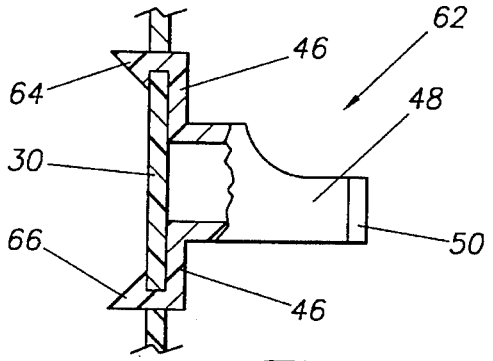
FIG. 8 is a cross-sectional view of an alternative embodiment of the lug element with a tine structure that is securely mounted upon the base plate of the housing of the printer.

The embodiment shown in FIG. 8 consists of the snap-in configuration 62, which is an alternative embodiment of this invention. The snap-in configuration would be useful in cases wherein a lug element needs to be attached to the relatively long-lived portion (machine) by pressing the lug element into preformed holes which already exist in the housing, and are adapted for the insertion of top tine 64 and bottom tine 66 into the holes within the base plate 30. The tines are integrally formed with the mounting portion 46 of the lug element. In FIG. 8, the projecting portion 48 and the corner facet 50 of the lug element may be seen. The embodiment shown in FIG. 8 may be useful in cases whereby it is messy, inconvenient, or otherwise not desirable to glue a lug element adhesively to the surface of the plastic. In some cases, the composition of the plastic, or the quality of the adhesive may be effected by humidity, temperature conditions inside the printer, or other factors which would make the adhesive not adhere properly, in which case the lug element might accidently fall off the housing, into another portion of the printer. This result is undesirable because it might damage the printer, and the keying aspects of the invention would be lost in that case. By the use of tines, the lug element could be irreversibly attached to the housing, and additional advantage of this embodiment is that a consumer or operator might be less likely to discover that the lug element is indeed removable, and not a permanent portion of the housing. With the adhesive option, it may occur that a small amount of adhesive is extending out from around the edge of the mounting portion 46, which would give an operator or consumer a clue that the lug element might be detached from the printer.

Figure 9:
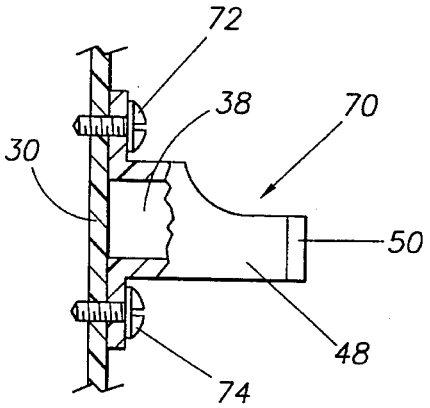
FIG. 9 is a cross-sectional view of another alternative embodiment of the lug element of the invention showing a screw-in structure in which the lug element is attached by screws to the base plate of the housing of the printer.
Figure 10:
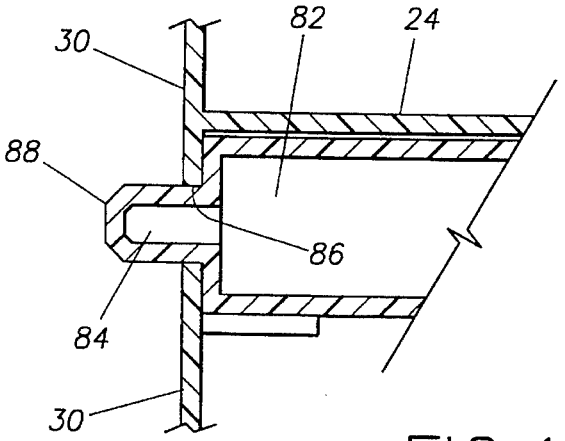
FIG. 10 is a cross-sectional view of another alternative embodiment of the invention in which the lug element is mounted on the consumable cartridge, and the void space is within the base plate of the housing of the printer.

FIG. 9 shows an alternative embodiment of the invention in which the screw in configuration 70 is shown. A projecting portion 48 of the lug element, and the corner facet 50 is seen in FIG. 9. A top screw 72 and a bottom screw 74 are inserted into and screwed into the base plate 30 to provide a permanent (yet removable) adherence of the lug element to the base plate 30 of the housing. The embodiment of FIG. 9 might be used in those cases in which it is desirable to insert a lug element for a certain length of time, but to then remove the lug element if it becomes desirable to not have it in the machine. For example, in the case where machinery is rented to consumers, it might be desirable to provide a keying element for one consumer, and then remove it by simply removing the screws and taking the lug element off for another consumer. Further, the embodiment of FIG. 9 could be added to a presently existing printer by simply drilling holes and attaching the lug element, with screws, to the base plate 30 of the housing of the printer. The embodiment shown in FIG. 9 may be useful in cases where the lug element must be removed at some point. For example, if a lug element is broken and must be replaced, the embodiment shown in FIG. 8 might require that the technician or the repair person disassemble the printer housing itself in order to reach the back side of the housing, and to release the tines, allowing replacement of a broken lug element. On the other hand, the replacement of a broken lug element using the embodiment of FIG. 9 could perhaps be easily accomplished without the disassembly of the machine, by removing the screws, and screwing in another lug element.

Further, the embodiment of FIG. 9 might be useful in applications whereby different size lug elements could be used to allow for keying of different types of toner cartridges. In that case, the length of the projecting portion 48 of the lug element might determine whether or not a certain toner cartridge would fit. Additionally, the width of the lug element 38 might be determinative of certain characteristics, and whether or not a toner cartridge would properly fit within a machine using a given configuration.

A person skilled in the art will recognize that this invention is not limited to the situation in which the lug element is extending from the relatively long-lived portion, and projecting into the consumable cartridge. For example, in FIG. 10, an alternative embodiment of this invention shows the situation in which the consumable cartridge 82 itself contains a projecting portion 84 defining a lug element 88. In that case, the consumable cartridge itself contains the lug element which extends into the housing of the base unit, or the printer in this case. The void space 86, shown in FIG. 10, comprises a hole into which the cartridge must fit to facilitate operation of the cartridge within the machine. Obviously, any of the attachment methods shown herein for attaching a lug element to the housing of a machine or printer could also be used to attach the lug element to the consumable cartridge 82 shown in the alternative configuration of FIG. 10.

A number of different types of office equipment comprise a generally large and durable (i.e., relatively permanent or long-lived) piece of equipment that uses ribbon, ink, paper, toner, tape or the like (i.e., consumable material) that is delivered to the relatively permanent piece of equipment in a tray, module, cartridge, or other container. By some means, the tray, module, cartridge, or other container is connected to the relatively permanent piece of equipment so that the consumable material can readily be transported to or otherwise used by the relatively permanent piece of equipment during operation. Quite often, this connection of the "container" to the relatively piece of equipment involves insertion of the container into a slot formed in the relatively permanent piece of equipment. At some depth of insertion into the slot, the container and the relatively permanent piece of equipment operatively engage, and the consumable material is used as previously mentioned.

Further, several of the embodiments of this invention use lug elements which are "self-fixturing", which means that the lugs fit snugly into the void spaces without having to be guided or placed into position with special attention from the operator. The geometric shape of the lug elements allow this self-fixturing aspect of this invention to occur, and an operator or consumer typically is not required to pay any particular attention to the lug element when inserting a cartridge in this invention. This is an advantage of the invention.

Further, a person skilled in the art would recognize that this invention may be practiced with only one lug element, or with several lug elements. The number of lug elements desired will depend upon the cost of providing the lug elements, the amount of "keying" desired in a particular application, and the likelihood that a consumer or operator of a machine would be able to defeat the keying aspect of the invention in that particular application. Of course, the preferred embodiment in this invention shows the use of two lug elements with a toner cartridge, but any number of lug elements could be used, and this invention is not limited to any particular number of lug elements.

Furthermore, in this invention, lug elements and void spaces are positioned so as not to interfere with the operation or complicate the design of other system elements. Additionally, in the embodiments of this invention, the use of adhesive, as a preferred method and apparatus, provides manufacturing flexibility, and allows changes to be made quickly. The self-fixturing aspect of the invention also simplifies manufacturing.

The invention herein allows improvements to the design of the consumable cartridge to be back-fitted into old machines. For example, an old machine may have no lugs and an old consumable cartridge may have no void space. New machines and new consumable cartridges, on the other hand, may have both lug elements and slots, respectively. In that case, an old consumable (having no slot) could fit into an old machine which has no lug element, but it could not fit into a new machine which has lug elements. On the other hand, a new consumable which has void spaces, however, could fit into either an old or a new machine. This "back fitting" characteristic of the embodiments of this invention is one of its positive characteristics, which makes the invention desirable in many applications.

Obviously, numerous other modifications and variations are possible in view of the teachings in this invention. Accordingly, the present invention may be practiced in numerous ways other than those ways shown in the specific embodiments and figures in this disclosure, while still falling within the scope and spirit of the invention, and such embodiments may be equivalents to this invention.

What is claimed is:

1. A system comprising two components which are keyed to each other to facilitate categorization of one of the components, comprising:

(a) a first component which is relatively long-lived portion;

(b) a second component which is a consumable cartridge; and (c) categorization means for categorizing one of said two components by providing a keying interconnection between said first component and said second component, said categorization means comprising a lug element formed on said first component and a void formed within said second component, said void defining an enclosed area shaped like said lug element, said lug element being insertable into said void to form said keying interconnection;

(d) said first and second components operably engaging each other only when said lug element is inserted into said void.

2. A system recited in claim 1, wherein the means for operably connecting the lug element to said first component comprises self-fixturing means.

3. The system recited in claim 1, wherein said lug element comprises a projecting portion and a base portion, and wherein the lug element may be released from its mounted position on said first component by means which are not readily observable by an operator.

4. The system recited in claim 3, wherein the lug element is connected by adhesion, the base portion adopted to engage said first component by being adhesively mounted on one of the components.

5. The system as recited in claim 3, wherein the lug element is operably connected by a snap-in releasable attachment, and the base portion is adapted to engage said first component by being snapped into place.

6. The system as recited in claim 3, wherein the lug element is operably connected by screws, wherein said base portion is screwed to said first component.

7. A system for categorizing an attachment to a machine when the attachment is releasably engaged to the machine, said system comprising:

(a) an attachment including a housing; and (b) categorization means for categorizing said attachment to said machine by providing a keying interconnection between said machine and said attachment, said categorizing means comprising a lug formed on said machine and a slot formed within said housing, said slot defining an enclosed area shaped like said lug, said lug being insertable into said slot to form said keying interconnection;

(c) said attachment operably engaging said machine only when said lug is inserted into said slot.

8. A system for categorizing removable cartridges used in a machine, the system comprising:

(a) a machine, the machine comprising a housing within the machine (b) a removable cartridge; and (c) categorization means for categorizing said removable cartridge by providing a keying interconnection between said removable cartridge and said machine, said categorization means comprising a lug formed on said housing and a slot formed within said removable cartridge, said slot defining an enclosed area shaped like said lug, said lug being insertable into said slot to form said keying interconnection;

(d) said removable cartridge operably engaging said machine only when said lug is inserted into said slot.

9. A system for distinguishing among consumable cartridges which engage a machine in a releasable manner so as to preserve a high quality of output of the machine, comprising:

(a) a consumable cartridge of high quality including a cartridge cover;

(b) a machine comprising an inner housing; and (c) distinguishing means for distinguishing said consumable cartridge from cartridges of different quality by providing a keying interconnection between said consumable cartridge and said machine, said distinguishing means comprising a projecting member formed on said inner housing and a void space formed within said cartridge cover, said void space defining an enclosed area shaped like said projecting member, said projecting member being insertable into said void space to form said keying interconnection;

(d) wherein the consumable cartridge fully releasably engages the machine, and is keyed to the machine, only when the projecting member is inserted into the void space, thereby assisting in the preventing the use of cartridges which are not of high quality, thereby maintaining the higher quality of output of the machine.

10. A machine which has consumable components and which contains a system of regulating the quality of output using a keying mechanism in conjunction with the consumable components, comprising:

(a) an inner housing;

(b) a consumable component; and (c) a keying mechanism, said keying mechanism being capable of providing a keying interconnection between said consumable component and said inner housing, said keying mechanism comprising a projecting member formed on said inner housing and a void space formed within said consumable component, said void space defining an enclosed area shaped like said projecting member, said projecting member being insertable into said void space to form said keying interconnection;

(d) wherein the quality of the output of the machine is regulated by the fact that consumable components of lesser quality which do not contain a void space cannot fully engage the machine, resulting in a higher quality output being obtainable from the machine, and a lowered incidence of operator error.

11. A method of operating machinery which preserves a high quality output while reducing incidence of error, comprising:

(a) inserting a consumable cartridge into a relatively long-lived component;

(b) engaging a lug element mounted to the long-lived component into an enclosed void space within the consumable cartridge, the void space being shaped substantially like the lug element, thereby keying the consumable cartridge to the relatively long-lived component;

(c) operating the machinery using the consumable cartridge;

(d) discarding and replacing the consumable cartridge after it is consumed; and (e) producing the high quality output with a reduced risk of operator error;

(f) wherein the consumable cartridge is fully inserted into the long-lived component only when the lug element engages the void space.

12. The method of claim 11, wherein the relatively long-lived component comprises a printer, and the machinery is operated to produce printed materials.

13. The method of claim 11, wherein the consumable cartridge is a toner cartridge, and toner is applied to paper in producing an image.

14. A printing apparatus, comprising:

a toner cartridge;

a receptacle housing which receives the toner cartridge; and categorization means for categorizing said toner cartridge by providing a keying interconnection between said toner cartridge and said receptacle housing, said categorizing means comprising a lug element formed on said receptacle housing and a void space formed within the toner cartridge, said void space defining an enclosed area shaped like said lug element, said lug element being insertable into said void space to form said keying interconnection;

wherein the toner cartridge is fully received by the receptacle housing only when the lug element is inserted into the void space.

15. The printing apparatus of claim 14, wherein the lug element is removably mounted to the receptacle housing, and wherein the lug element may be released from its mounted position on the receptacle housing by means which are not readily observable by an operator.

16. A system for categorizing a releasable attachment to a machine, comprising:

a machine having a void configured to receive a lug;

a releasable attachment to said machine having a lug substantially similar in shape to said void; and a keying interconnection formed by insertion of said lug into said void to operably engage said machine.

17. A printer apparatus, comprising:

a printer having a receptacle configured to receive a lug of a printing cartridge; and a printing cartridge having a lug configured to mate with said receptacle, the mating of said lug and said receptacle forming a keying interconnection that is required for said printer to operate.

* * * * *

UNITED STATES PATENT AND TRADEMARK OFFICE

CERTIFICATE OF CORRECTION

PATENT NO. : 5,559,589

DATED : September 24, 1996

INVENTOR(S) : David Eicheberg and Nicholas G. Forlenza

It is certified that error appears in the above-indentified patent and that said Letters Patent is hereby corrected as shown below:

Under Section 56 of the Cover Page, please insert --FOREIGN PATENT DOCUMENTS H1-314255 6/1988 Japan--.

Column 4, line 37, replace "lap on" with --upon--.

Signed and Sealed this

Twenty-first Day of January, 1997

*Attest:*

Bruce Lehman

BRUCE LEHMAN

*Attesting Officer*

*Commissioner of Patents and Trademarks*